United States Patent [19]

Montgomery et al.

[11] Patent Number: 4,742,993

[45] Date of Patent: May 10, 1988

[54] SELF-ALIGNING QUADRANT FAIRLEAD

[75] Inventors: James L. Montgomery, Seattle, Wash.; Geoffrey B. H. Breese; Peter G. S. Dove, both of Houston, Tex.

[73] Assignee: Smith Berger Marine, Inc., Seattle, Wash.

[21] Appl. No.: 904,573

[22] Filed: Sep. 4, 1986

[51] Int. Cl.[4] ..... B65H 57/00

[52] U.S. Cl. ..... 254/389; 226/196; 242/157 R

[58] Field of Search ..... 254/389, 415, 394; 226/195, 197, 196, 199; 242/157 R

[56] References Cited

U.S. PATENT DOCUMENTS

| | | | |
|---|---|---|---|
| 928,766 | 7/1909 | Johnstone | 254/415 X |
| 1,275,395 | 8/1918 | Corbett | 254/389 |
| 1,340,420 | 5/1920 | Settle | 254/389 |
| 1,546,649 | 7/1925 | Glynn | 254/389 |
| 1,699,478 | 1/1929 | Rutter | 254/415 |
| 1,712,478 | 5/1929 | Monroe | 254/394 |
| 1,805,800 | 5/1931 | Berger | 254/395 |
| 1,828,269 | 10/1931 | Wright | 254/389 |
| 3,052,450 | 9/1962 | Trunnell | 254/389 X |
| 3,892,386 | 7/1975 | Hogan | 254/389 X |
| 4,260,119 | 4/1981 | Price | 242/157 R |
| 4,274,165 | 6/1981 | Ivko et al. | 254/389 X |
| 4,430,023 | 2/1984 | Hayes et al. | 405/224 |
| 4,640,496 | 2/1987 | Van Hoomisen et al. | 254/415 |

FOREIGN PATENT DOCUMENTS

| | | | |
|---|---|---|---|
| 534913 | 12/1956 | Canada | 254/389 |

*Primary Examiner*—John Petrakes
*Assistant Examiner*—Joseph J. Hail, III
*Attorney, Agent, or Firm*—Robert W. Beach; Ward Brown

[57] ABSTRACT

An arcuate fairlead for mooring lines has an arcuate row of grooved line-engaging shoes of plastic material which shoes can be removed and replacement shoes can be installed without disassembling the mooring line from the fairlead. The fairlead is of generally triangular shape supported by trunnion and bearing means at its upper tip and adjacent to its apex enabling the fairlead to swing about an upright axis for self-alignment with a stretch of mooring cable beyond the lower tip of the fairlead.

16 Claims, 4 Drawing Sheets

SELF-ALIGNING QUADRANT FAIRLEAD

BACKGROUND OF THE INVENTION

1. Field of the Invention

This invention relates to an arcuate mooring line fairlead, preferably of substantially quadrant shape, which is stably self-aligning with a stretch of line extending beyond the fairlead.

2. The Problem

The fairlead of the present invention is used in conjunction with lines to be guided such as mooring lines of large diameter which are under heavy, fluctuating loads. Such lines are used, for example, to moor floating oil drilling rigs, construction platforms or processing platforms and, consequently, are almost continuously working as the result of wind, wave, tide and current action. Such working is conducive to wear of any line guide apparatus and to chafing and ultimate failure of even large mooring lines if they are not properly guided and protected. Such large cables are subject to fatigue failure if they are bent on a curvature of small radius for an extended period of time. The problem is aggravated by such lines being redirected by some type of guide apparatus through a substantial arc, such as from about 45 degrees to about 180 degrees, for example, between vertical and near horizontal or from horizontal to almost directly downward.

3. Prior Art

A quadrant type of self-aligning fairlead is disclosed in the roller sheave of U.S. Pat. No. 1,712,478, issued May 7, 1929, but such sheave is not stably self-aligning in the sense that tilting of the sheave about the axis of the arc is not restrained.

Also, U.S. Pat. No. 4,260,119, issued Apr. 7, 1981, shows a quadrant fairlead of the roller type generally as in U.S. Pat. No. 1,712,478, but it is not self-aligning.

U.S. Pat. No. 4,430,023, issued Feb. 7, 1984, shows an arcuate rope guide tube of the contiguous contact surface type rather than of the roller type, but it is not self-aligning and has an undesirably small passage through it.

A self-aligning pulley for a line is shown in U.S. Pat. No. 1,805,800, issued May 19, 1931.

SUMMARY OF THE INVENTION

It is a principal object of the present invention to provide a nonrotative fairlead which is self-aligning as the rig moored swings or turns but which is stable so as to provide proper control over the mooring line despite change in degree and direction of forces applied by the line to the fairlead.

More specifically, it is an object to provide an arcuate fairlead for a mooring line or other line that is swingable about an axis for self-alignment with a stretch of the line extending beyond the fairlead but which is restrained from tilting lengthwise of the line or about the axis of the fairlead arc.

Another object is to provide generally uniform distribution of the load over the length of the fairlead arc when the line is under load while allowing adequate movement of the line when the line is slack.

A further object is to provide a fairlead which will minimize friction on the line and protect the line by being softer than the line while being adequately wear-resistant.

It is also an object to provide an arcuate fairlead that will not deteriorate quickly when under salt water and which requires little maintenance despite its self-aligning capability.

An additional object is to provide a fairlead for mooring lines including at least one and preferably more line-guiding wear parts such as shoes that can be replaced quickly and easily when necessary without disassembling the line from the fairlead.

The foregoing objects can be accomplished by an arcuate fairlead for a mooring line mounted by trunnions for free swinging about an axis and which fairlead has a series of grooved shoes contiguously engageable by a mooring line which shoes are slidably mounted in the fairlead so that they can be readily slid endwise out of the fairlead and replacement shoes can be slid into the fairlead without disassembling the mooring line from the fairlead.

DETAILED DESCRIPTION

The curved fairlead of the present invention is intended principally for use with large and long undersea mooring lines such as used for anchoring marine oil drilling rigs, construction platforms or processing platforms. Customarily, such rigs, because of their large size and the great forces of wind, waves, tide and sea currents to which they may be subjected must be anchored by steel cable mooring lines, which may be five inches (12.70 cm) in diameter, or chain, and each of such lines may be 1 mile (1.609 km) or more in length. Consequently, the problem of controlling the mooring lines so that they will be secure under conditions of great stress such as may occur in a storm and yet utilize equipment requiring little maintenance and having long life is serious.

Figure 2:
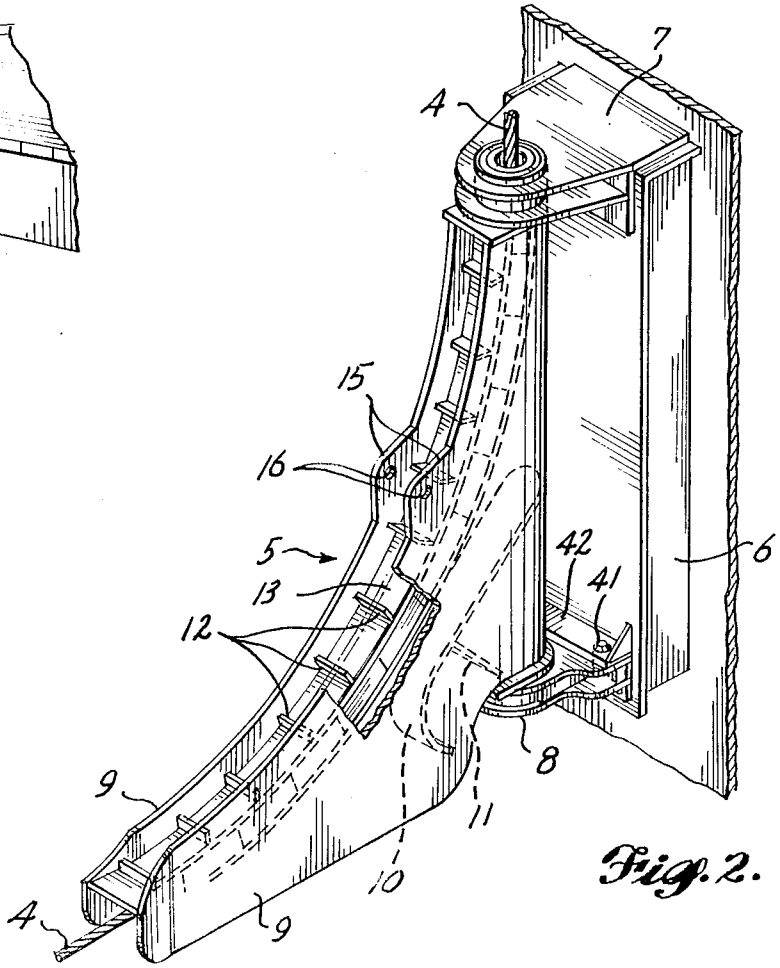
FIG. 2 is a top perspective of an arcuate fairlead of the present invention.
Figure 1:
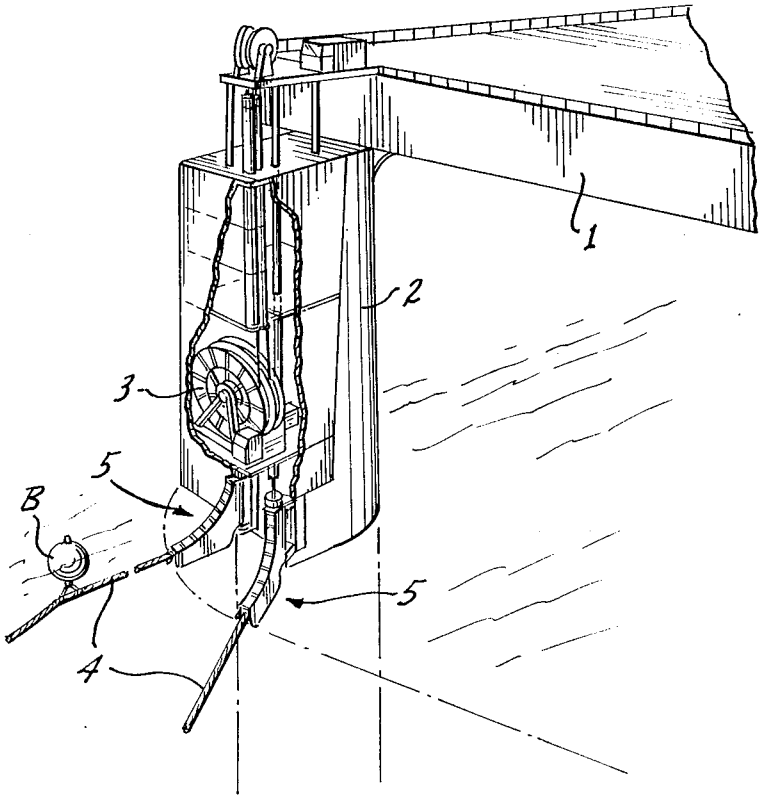
FIG. 1 is a top perspective of a corner fragment of a marine oil drilling rig or other floating platform equipped with arcuate fairleads of the present invention.

Usually marine floating oil drilling rigs or floating platforms are generally rectangular, each corner being connected to two undersea anchors by long mooring lines. FIG. 1 shows diagrammatically one corner 1 of the working platform of such a rig which is elevated above the surface of the water. A casing or housing 2 for winch mechanism 3 depends from the platform 1. Two mooring lines 4 are connected to the winch mechanism which can be used to haul such lines or to maintain suitable tension on them to limit swinging or shifting of the rig.

In deep water operations, the anchors are located at a considerable distance from the rig. Because the mooring lines are so heavy, the catenary stretches outwardly from the rig are supported by large submersible buoys B to be near horizontal at the fairleads so as to reduce the vertical loads on the rig, whereas the stretches of the lines between the fairleads and the winch mechanism are vertical. The nonrotative curved, preferably circular arcuate, fairlead of the present invention can guide and control the bends in the lines between the near horizontal stretches and the upright stretches. In most instances the fairlead is of substantially quadrant shape because usually it defines an arc of approximately 90 degrees between vertical and near horizontal, but the same type of construction can be used for fairleads having a circular arc of lesser extent, such as the deflecting or bending member or shoe 21 shown in FIG. 3 of U.S. Pat. No. 4,430,023, the arc of which may be of the order of 48 degrees, as stated in column 5, line 17, or of greater extent, such as up to about 180 degrees. Actually, the extent of the arc of the present fairlead is immaterial as far as the construction is concerned. The essential feature is that the line-engaging surface of the fairlead be curved, preferably of circular arcuate shape.

The nonrotative arcuate fairlead designated generally 5 is supported from mounting 6 between an upper bracket 7 and a lower bracket 8 projecting from such mounting. The fairlead is composed of two parallel side plates 9 of generally triangular shape disposed in spaced parallel relationship in upright planes with one leg substantially vertical and the other leg substantially horizontal. The hypotenuse of each side plate is preferably arcuate, generally concentric with the bend in the mooring cable 4 passing through the fairlead between such side plates. The side plates are secured in spaced relationship by spacer and connecting plates perpendicular to and between such side plates. One such plate 10 is interposed between the side plates adjacent to their apexes and extends generally parallel to the hypotenuses of the side plates. Such spacer plate is supplemented and reinforced by another spacer and connecting plate 11 disposed perpendicular to the spacer and connecting plate 10 preferably in a plane substantially bisecting the apex angles of the side plates.

Figures 3, 4, 5, 6:
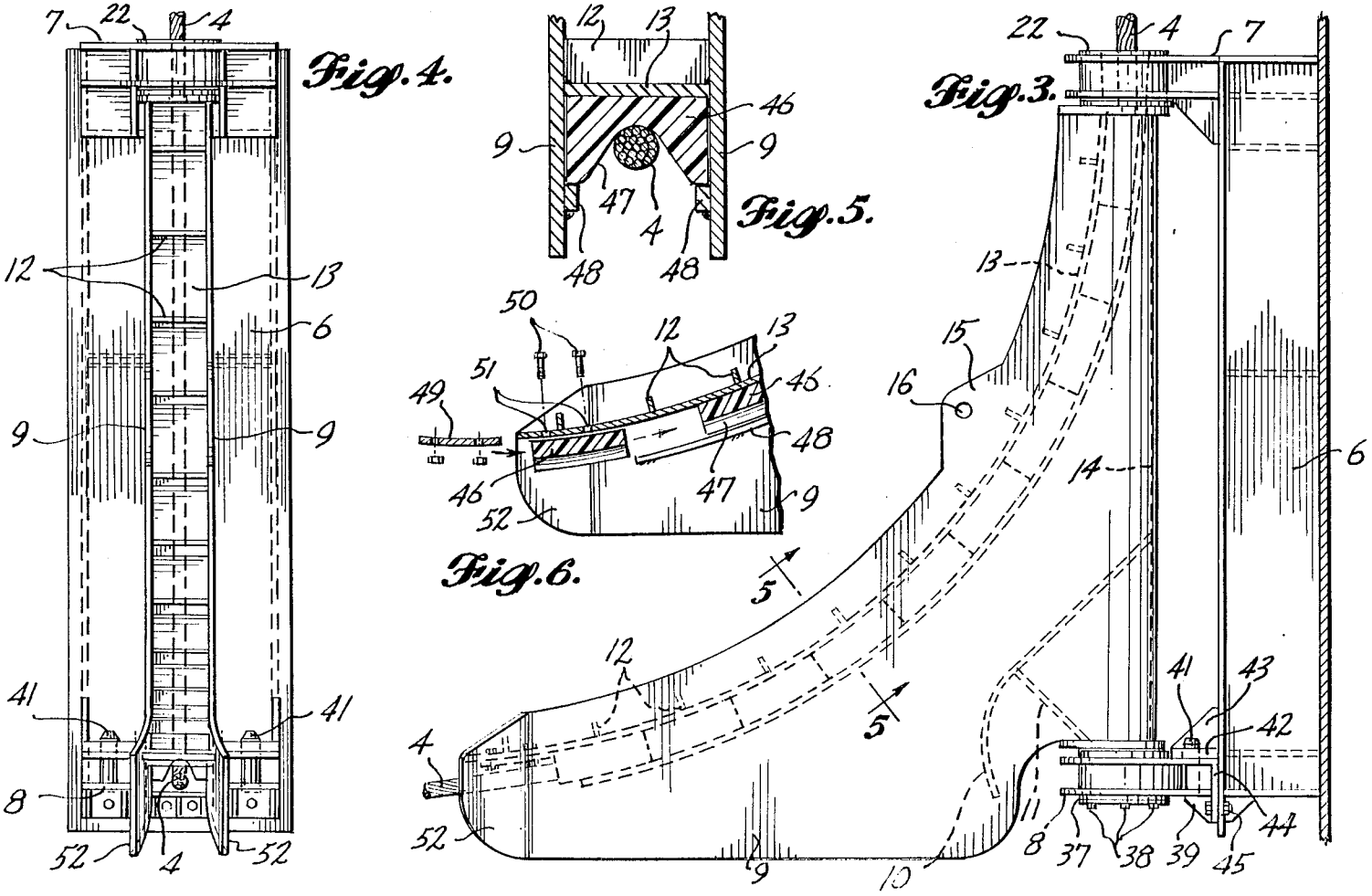
FIG. 3 is a side elevation.
FIG. 4 is an edge elevation of the arcuate fairlead shown in FIG. 2.
FIG. 5 is a fragmentary section of a portion of the fairlead taken on line 5—5 of FIG. 3.
FIG. 6 is a vertical section through the lower tip portion of the fairlead.
Figure 7:
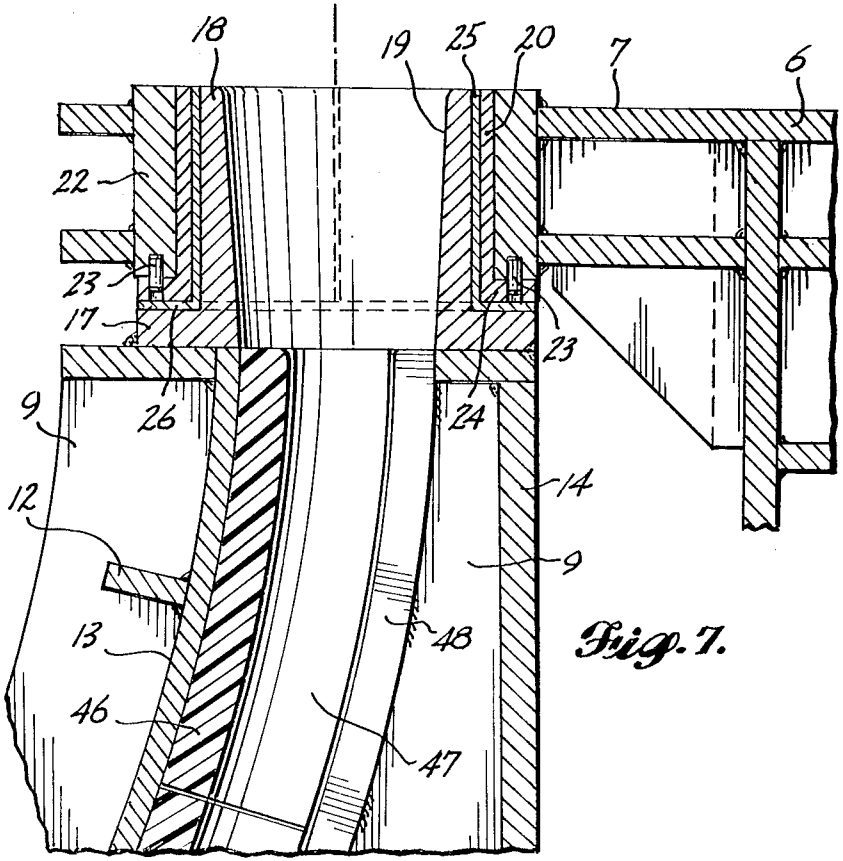
FIG. 7 is an enlarged vertical section through the upper tip portion of the fairlead and its mounting structure.

The hypotenuses of the side plates are connected by short spacer bars 12 spaced circumferentially of the fairlead arc and each disposed substantially in a radial plane of the fairlead arc. The inner edges of the spacer bars 12 are connected together as shown in FIG. 7 by a circular arcuate connecting and spacer plate 13 welded to the side plates 9 and preferably also welded to the spacer bars 12. The upright edges of the side plates 9 are connected by a connecting and spacer bar 14 as indicated in FIG. 3.

The fairlead is mounted generally in an upright plane with its arcuate hypotenuse facing outward and upward. Lugs 15 project outward and upward from the central portions of the side plates 9 and have in them hoisting eyes 16 in which books can be engaged to handle the fairlead for installation between the brackets 7 and 8 of the mounting 6 and removal from such mounting. The fairlead is journaled for free swinging by supports at the upper tip of the fairlead and adjacent to its lower apex. Such supports restrain tilting of the fairlead lengthwise of the line or around the axis of the circular arc of the fairlead as a result of force exerted by the line on the fairlead.

Figure 8:
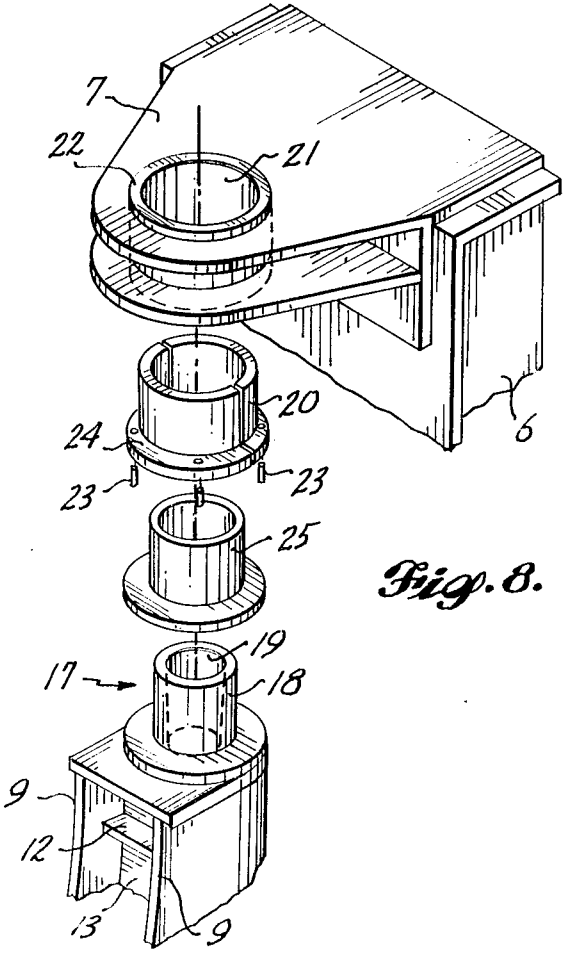
FIG. 8 is a top perspective of the same portion of the fairlead showing parts in exploded relationship.

The upper mounting structure is shown best in FIGS. 7 and 8 as including a boss projecting upward from the tip of the upper leg of the fairlead side plates 9 forming a trunnion 18 having through it a bore 19 for passing the mooring line 4. Such bore preferably flares upward to some extent to enable the mooring line to be deflected angularly a small amount without contacting the inner surface of the trunnion. Such trunnion fits within a sleeve 20 that in turn is received within the bore 21 of a collar 22 secured in the outer end of the bracket 7 such as by welding. Such sleeve can be held in the collar by pins 23 extending through apertures in the external flange 24 on the lower end of the sleeve and into the lower end of the collar 22. To reduce friction and wear, a bearing bushing 25 of underwater bronze is interposed between the trunnion 18 and the sleeve 20. Such bushing has an external flange 26 underlying the flange 24 of the sleeve so that the bearing is adapted to resist both radial and upward thrust loads.

Figure 10:
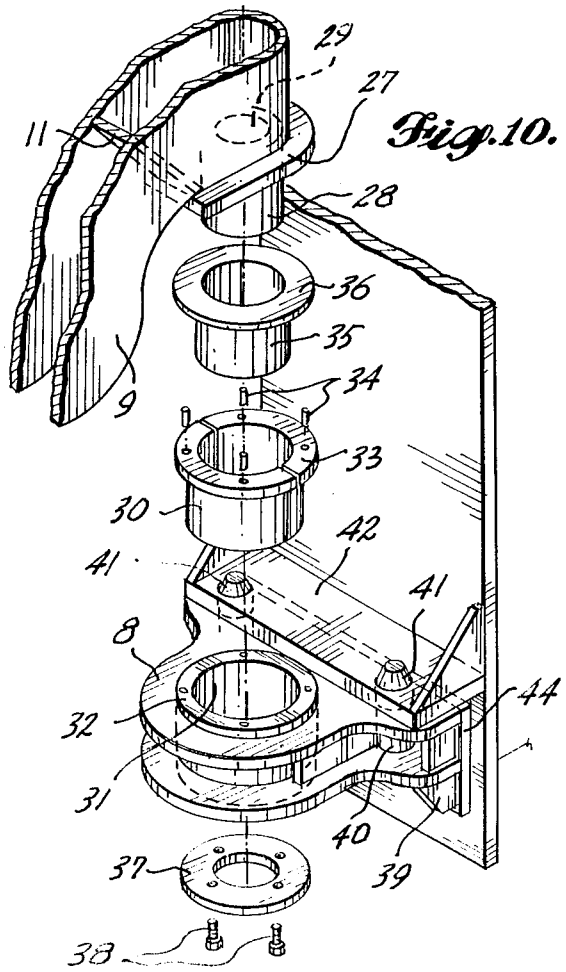
FIG. 10 is a top perspective of the same portion of the fairlead showing parts in exploded relationship.
Figure 9:
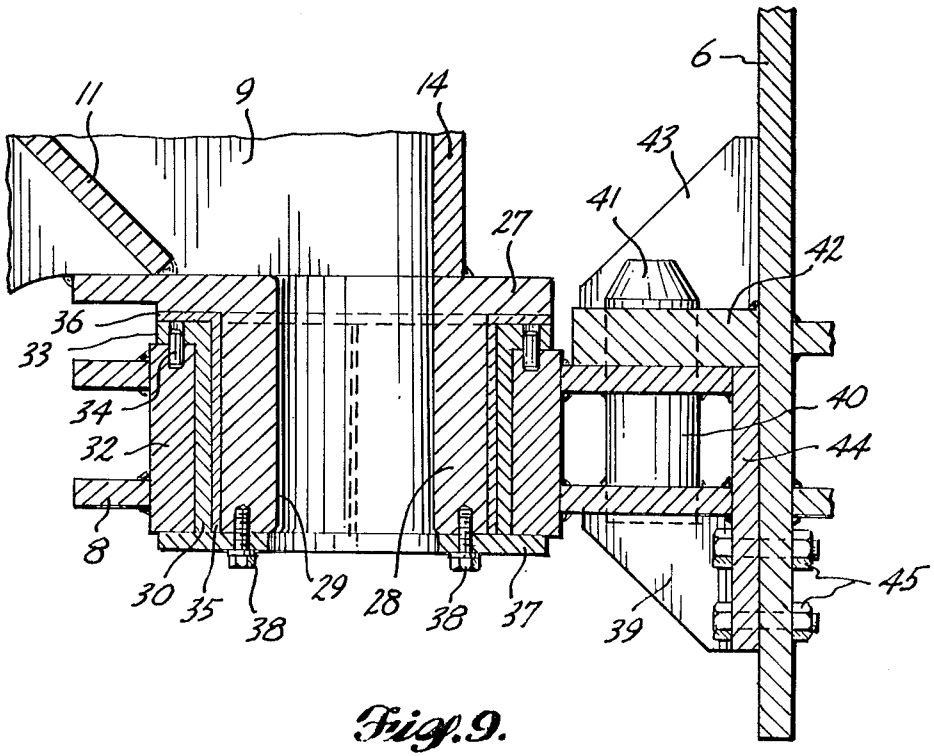
FIG. 9 is a vertical section through the lower apex portion of the fairlead and its mounting structure.

The lower mounting or support for the fairlead apex is shown in FIGS. 9 and 10, being indicated generally as 27. This mounting includes a trunnion 28 having a nonfunctional bore 29 extending through it. This trunnion fits into the bore of a sleeve 30 which in turn fits into the bore 31 of a collar 32 carried by the lower bracket 8. An external flange 33 on the upper end of the sleeve 30 is secured to the upper end of the collar 32 by axial pins 34 extending through the sleeve flange downward into the upper end of the collar.

Wear of the trunnion 28 and sleeve 30, 33 by relative rotation of these parts is minimized by providing between them a bushing 35 having an external flange 36 which bushing is made of underwater bronze to withstand both radial loads of the trunnion on the bearing and axially downward thrust loads of the trunnion on the bearing. The bearing parts are held in assembled relationship by a flat plate retainer ring 37 beneath the trunnion and bearing and of a radial width and diameter for straddling the major portion of the tubular trunnion and bearing. Such retainer ring is held in place by cap screws 38 extending through the retainer ring and threaded into tapped holes in the lower end of the trunnion. Several such cap screws are provided, four being shown in FIG. 10, which are spaced circumferentially of the trunnion 28.

The bracket 8 includes a removable part that can be braced by gusset plates 39 spaced parallel to the fairload mounting wall 6 and located beneath the bracket. Such removable bracket part carries two upright pins 40 spaced apart parallel to the wall 6 and having upwardly projecting cantilever ends 41 receivable respectively in apertures in an attachment plate 42 secured to the wall 6 and braced relative to the wall by gussets 43 spaced apart parallel to the wall and overlying the attachment plate. The removable part of the bracket 8 includes a backing plate 44 secured to the mounting plate 6 by two or more pairs of upper and lower bolts 45 extending through the backing plate 44 and the mounting plate 6, as shown in FIG. 9. Such bolts will prevent the removable portion of the bracket from dropping down relative to mounting plate 6 so that the ends 41 of pins 40 would be withdrawn from the apertures in attachment plate 42, but the principal loads on the trunnion 28 toward and away from the mounting wall 6 and generally horizontal parallel to such wall will be transmitted by the pins 40, 41 to the mounting wall through the attachment plate 42 rather than through the bolts 45. To accomplish this purpose, the pins 41 may fit quite snugly in the holes in the attachment plate 42, whereas the bolts 45 may fit loosely in the holes in the backing plate 44 and/or mounting plate 6.

The nonrotative curved mooring line contacting surface of the fairlead is substantially continuous so as to provide contiguous contact of the mooring line with the convex guiding surface of the fairlead. The line-guiding surface is a groove which preferably is a circular arc. The convex mooring line groove is formed by nonrotative curved end-bulting channel guide shoe sections 46 each having a groove 47 opening into the space between the side plates 9, as shown in FIGS. 5, 6 and 7. The bottoms of these shoe sections are curved complemental to and contiguously engage the convex side of the circular arcuate connecting plate 13 as shown in FIGS. 5 and 7 to provide backing for the shoes. The shoes are held in place by ribs 48 formed by circular arcuate strips extending parallel to the circular arcuate connecting plate 13, spaced radially from the connecting plate a distance approximately equal to the thickness of the guide shoes, secured to the inner faces of the side plates 9 by welding, as indicated in FIGS. 5 and 7, and engageable by the edges of the channel shoe sections.

Preferably the shoe sections are relatively short, such as from 12 to 30 inches (30.48 to 76.20 cm) in length, so that they can be handled readily. There can, for example, be four to thirty of such sections cooperatively forming a groove 10 to 30 feet (3.0 to 9.1 m) long. If the guiding channel were sufficiently short there could be only a single removable shoe. The shoe sections can be slide endwise circumferentially into the space between the circular arcuate connecting plate 13 and the circular arcuate retaining ribs 48 from the tip of the lower arm of the fairlead quadrant and pushed lengthwise until the upper section engages the trunnion 19. The row of shoe sections can be held in such assembled relationship with the grooves of adjacent shoes in registration by a stop plate 49 secured to the lower end of the connecting plate 13 by bolts 50 passing through apertures 51 in such connecting plate.

The shoe sections 46 can be made of metal, such as brass, aluminum or soft aluminum alloy, softer than the mooring line cables, but the shoe material preferably is of plastic which is softer than the mooring line cables, such as nylon.

In order to assemble the fairlead structure, the cable 4 must be threaded lengthwise through the space between the side plates 9 either before or after the fairlead has been mounted on brackets 7 and 8. The series of guide surface shoes 46 can be assembled into the fairlead either before or after the cable has been threaded through it. Preferably the backing bars 12 for the plate 13 are located, respectively, near the longitudinal center of each shoe section.

Whether or not the cable has been threaded through the fairlead, the fairlead can be mounted on the mounting 6 by inserting the upper trunnion 18 into the bearing bushing 25 which is in turn inserted into the sleeve 20 that is inserted into the bore 21 of the bearing collar 22. Next the bushing 35 can be applied to the lower trunnion 28 followed by placing sleeve 30 over the bushing 35 and the lower collar 32 of the bushing 8 over the sleeve 30 at the same time that the ends 41 of pins 40 are inserted through the apertures of attachment plate 42. The bolts 45 can then be secured through backing plate 44 of the lower bushing and mounting plate 6 to hold the bracket 8 in place. Finally the retainer plate 37 can be secured to the lower end of the lower trunnion 29 by the cap screws 38. If the line contact shoe sections 46 have been assembled in the fairlead and the mooring line has been threaded through the fairlead, the assembly operation will have been completed.

Because of the swingable mounting of the fairlead by the upper trunnion 18 on the upper tip of the fairlead and the lower trunnion 28 near the lower apex of the fairlead, the fairlead will be self-aligning with the stretch of mooring line beyond the lower tips of the side plates 9 so that the fairlead will swing to accommodate not only the initial positioning of the moored rig and the anchor to which the mooring line is attached, but to accommodate any shifting, turning or rocking of the rig that may occur to keep the plane of the mooring line and the plane of the fairlead guide groove always in the same upright plane. The side plates 9 may have flared lower tips 52 simply to facilitate initial placement of the mooring line between such side plates. Because of the self-aligning character of the fairlead, the flaring 52 of the side plate tips is not necessary to prevent contact of the mooring line with the side plates.

If any one or more of the shoe sections 46 should become worn excessively, the bolts 50 can be removed to enable retainer plate 49 to be shifted so that the mooring line contact shoe sections 46 can be slid lengthwise out of the lower end of the fairlead without removing the mooring line 4 from between the side plates 9, although the mooring line should be slackened sufficiently so that it can drop down between the side plates virtually completely out of contact with the guide shoes 46 while being retained securely between the side plates. After the worn shoes 46 have been removed from between the side plates 9 and replaced by new shoes, the retainer plate 49 may again be secured to the connecting plate 13 by bolts 50 to hold the row of mooring line contact shoes in place between such connecting plate and the ribs 48 again.

We claim:

1. An arcuate fairlead for mooring lines comprising two side plates of generally triangular shape, each of said side plates having a hypotenuse and a tip portion, an arcuate connecting plate adjacent to said hypotenuses of said side plates and secured to said side plates for holding said side plates in spaced parallel relationship, a plurality of trough-shaped guide shoes arranged in a row with their bottoms in engagement with the convex side of said arcuate connecting plate for engagement by a mooring line, shoe-retaining means spaced from the convex side of said arcuate connecting plate and engageable with the trough edges of said guide shoes for limiting movement of said guide shoes away from said arcuate connecting plate, brace bars spaced circumferentially of said arcuate connecting plate and secured between said side plates and said concave side of said arcuate connecting plate for backing said arcuate connecting plate at circumferentially spaced intervals, a further connecting plate located between and connecting said side plates at a location spaced a substantial distance from said arcuate connecting plate for providing ample space for a mooring line between said arcuate connecting plate and said further connecting plate, a first trunnion carried by corresponding tip portions of said side plates, a second trunnion carried by the apex portion of said side plates aligned axially with said first trunnion, first bearing means engageable by said first trunnion, second bearing means engageable by said second trunnion, and means mounting said bearing means rigidly in spaced relationship for holding said trunnion means stably by preventing appreciable edgewise tilting of said side plates while mounting said side plates for swinging about the axis of said trunnions for self-alignment of said guide shoes with a stretch of the mooring line beyond said side plates.

2. The fairlead defined in claim 1, and means for retaining the guide shoes between the side plates and releasable to enable the guide shoes to be removed from between the side plates circumferentially of the arcuate connecting plate and replaced by other shoes while the mooring cable extends between the side plates, the arcuate connecting plate and the further connecting plate.

3. An arcuate fairlead for mooring lines comprising two side plates, an arcuate connecting plate secured to said side plates for holding said side plates in spaced parallel relationship, a plurality of trough-shaped guide shoes arranged in an arcuate row with their bottoms in engagement with the convex side of said arcuate connecting plate for engagement by a mooring line, and first shoe-retaining means spaced from the convex side of said arcuate connecting plate and engageable with the trough edges of said guide shoes for limiting movement of said guide shoes away from said arcuate connecting plate.

4. The fairlead defined in claim 3, including second shoe-retaining means mounted at one end of the arcuate row of guide shoes between the two side plates for preventing outward movement of the guide shoes lengthwise of their troughs along the connecting plate, said second shoe-retaining means being detachable to permit removal of the trough-shaped shoes from between the side plates by sliding such shoes outward generally along the arcuate connecting plate and the first shoe-retaining means.

5. The fairlead defined in claim 3, including brace bars spaced circumferentially of said arcuate connecting plate and having opposite ends secured respectively to said side plates and backing said concave side of said arcuate connecting plate at circumferentially spaced intervals.

6. The fairlead defined in claim 3, and means for retaining the guide shoes between the side plates and releasable to enable the guide shoes to be removed from between the side plates circumferentially of the arcuate connecting plate and replaced by other shoes while the mooring cable extends between the side plates in a position spaced from the arcuate connecting plate.

7. A fairlead for a line comprising curved nonrotative guide means engageable by a line and including two parallel closely-spaced side plates of generally triangular shape, each of said side plates having a concave arcuate hypotenuse and an upper tip, and mounting means guiding said guide means for swinging about an axis to enable said guide means to be self-aligning with a stretch of the line beyond said guide means and restraining tilting of said side plates lengthwise of the line as a result of force exerted by the line on said guide means, said mounting means including upper and lower trunnion and bearing means defining the axis about which said guide means can swing, said upper trunnion being mounted on said upper tips of said side plates and said lower trunnion being carried by the apex portions of said side plates, said guide means further including a plurality of line-engageable grooved shoes received between said side plates and arranged along their hypotenuses, and retaining means carried by said guide means for retaining said shoes in a row with the grooves of adjacent shoes in registration and said shoes being shiftable relative to said side plates for enabling said shoes to be removed from between said side plates and a set of replacement shoes to be inserted between said side plates while the line extends between said side plates.

8. A fairlead for a line comprising nonrotative guide means engageable by a line including two parallel closely-spaced side plates of generally triangular shape, each of said side plates having a hypotenuse and an apex opposite said hypotenuse, an arcuate connecting plate adjacent to said hypotenuses of said side plates and secured to said side plates for holding said side plates in spaced parallel relationship, a plurality of trough-shaped guide shoes arranged in a row with their bottoms in engagement with the convex side of said arcuate connecting plate for engaging a mooring line extending between said side plates, and a further connecting plate spaced from said arcuate connecting plate toward the apexes of said plates a distance sufficient to accommodate the line between said connecting plates out of contact with said guide shoes for enabling said guide shoes to be removed from between said side plates and a set of replacement shoes inserted between said side plates while the line extends between said side plates and between said connecting plates.

9. A fairlead for a line comprising two side plates disposed in parallel closely-spaced relationship, convexly curved backing means received between said side plates, a plurality of grooved shoes of channel shape for reception of a line between their flanges, located between said side plates, having webs concavely curved complementally to said convexly curved backing means and removably received between said side plates, and retaining means including flange-engageable means spaced from said backing means and engageable by the flanges of said channel-shaped shoes, guiding said shoes for sliding between said backing means and said flange-engageable means circumferentially of said backing means and blocking means adjacent to one end of said backing means for blocking sliding of said shoes along said backing means and retaining said grooved shoes in a row between said backing means and said flange-engageable means with the grooves of adjacent shoes in registration, said blocking means being removable to enable sliding of said shoes relative to said side plates for removal from between said slide plates while the line extends between said side plates.

10. An arcuate fairlead for mooring lines comprising two side plates having corresponding generally upright and generally horizontal leg portions meeting at a lower corner portion, a first trunnion carried by the upper portions of the upright leg portions of said side plates, a second trunnion carried by the lower corner portions of said side plates and aligned axially with said first trunnion, first bearing means engageable by said first trunnion, second bearing means engageable by said second trunnion, means mounting said bearing means rigidly in spaced relationship for holding said trunnion means stably by preventing appreciable edgewise tilting of said side plates while mounting said side plates for swinging about the axis of said trunnions, an arcuate connecting plate secured to said side plates for holding said side plates in spaced parallel relationship, a plurality of trough-shaped guide shoes arranged in an arcuate row with their bottoms in engagement with the convex side of said arcuate connecting plate for engagement by a mooring line, and shoe-retaining means spaced from the convex side of said arcuate connecting plate and engageable with the trough edges of said guide shoes for limiting movement of said guide shoes away from said arcuate connecting plate.

11. The fairlead defined in claim 10, in which the guide shoes are made of material softer than the material of a line engageable therewith.

12. The fairlead defined in claim 11, in which the shoes are made of plastic material.

13. An arcuate fairlead for mooring lines comprising two side plates of generally triangular shape, each of said side plates having a hypotenuse and a tip portion, an arcuate connecting plate adjacent to said hypotenuses of said side plates and secured to said side plates for holding said side plates in spaced parallel relationship, a plurality of trough-shaped guide shoes arranged in a row with their bottoms in engagement with the convex side of said arcuate connecting plate for engagement by a mooring line, shoe-retaining means spaced from the convex side of said arcuate connecting plate and engageable with a trough edge of each of said guide shoes for limiting movement of said guide shoes away from said arcuate connecting plate, spacing means remote from said arcuate connecting plate for providing ample space for a mooring line between said arcuate connecting plate and said spacing means when the mooring line is spaced radially of said arcuate connecting plate from said guide shoes, a first trunnion carried by corresponding tip portions of said side plates, a second trunnion carried by a portion of said side plates aligned axially with said first trunnion, first bearing means engageable by said first trunnion, second bearing means engageable by said second trunnion, and means mounting said bearing means rigidly in spaced relationship for holding said trunnion means stably by preventing appreciable edgewise tilting of said side plates while mounting said side plates for swinging about the axis of said trunnions for self-alignment of said guide shoes with a stretch of the mooring line beyond side plates.

14. An arcuate fairlead for mooring lines comprising two side plates of generally triangular shape, each of said plates having a hypotenuse, an arcuate connecting plate adjacent to said hypotenuses of said side plates and secured to said side plates for holding said side plates in spaced parallel relationship, a plurality of trough-shaped guide shoes arranged in a row with their bottoms in engagement with the convex side of said arcuate connecting plate for engagement by a mooring line, shoe-retaining means spaced from the convex side of said arcuate connecting plate and engageable with a trough edge of each of said guide shoes for limiting movement of said guide shoes away from said arcuate connecting plate, and spacing means remote from said arcuate connecting plate for providing ample space for a mooring line between said arcuate connecting plate and said spacing means when the mooring line is spaced radially of said arcuate connecting plate from said guide shoes.

15. An arcuate fairlead for mooring lines comprising two side plates of generally triangular shape, each of said side plates having a hypotenuse, an arcuate connecting plate adjacent to said hypotenuses of said side plates and secured to said side plates for holding said side plates in spaced parallel relationship, a plurality of trough-shaped guide shoes arranged in a row with their bottoms in engagement with the convex side of said arcuate connecting plate for engagement by a mooring line, shoe-retaining means spaced from the convex side of said arcuate connecting plate and engageable with a trough edge of each of said guide shoes for limiting movement of said guide shoes away from said arcuate connecting plate, and brace bars, one for each shoe, spaced circumferentially of said arcuate connecting plate and secured between said side plates and said concave side of said arcuate connecting plate for backing said arcuate connecting plate at circumferentially spaced intervals.

16. A fairlead for a line comprising curved nonrotative guide means engageable by a line including two parallel closely-spaced side plates, curved backing means located between said side plates, a plurality of line-engageable grooved shoes received between said side plates and arranged along said backing means, and retaining means for retaining said shoes in a row along said backing means with the grooves of adjacent shoes in registration and said shoes being shiftable relative to said backing means for enabling said shoes to be removed from between said side plates and a set of replacement shoes to be inserted between said side plates while the line extends between said side plates.

* * * * *

UNITED STATES PATENT AND TRADEMARK OFFICE

CERTIFICATE OF CORRECTION

PATENT NO. : 4,742,993

DATED : May 10, 1988

INVENTOR(S) : Montgomery et al.

It is certified that error appears in the above-identified patent and that said Letters Patent are hereby corrected as shown below:

Claim 6: column 7, lines 41 through 47: amend claim 6 to read as follows:

--6. The fairlead defined in claim 3, and second shoe-retaining means for restraining movement of the guide shoes circumferentially of the arcuate connecting plate between the side plates and releasable to enable the guide shoes to be removed from between the side plates circumferentially of the arcuate connecting plate and replaced by other shoes while the mooring cable extends between the side plates in a position spaced from the arcuate connecting plate.--

Claim 14: column 9, line 40, after "said" insert ...side...

Signed and Sealed this

Twentieth Day of September, 1988

*Attest:*

DONALD J. QUIGG

*Attesting Officer*

*Commissioner of Patents and Trademarks*